US007648428B2

(12) United States Patent
Nagasawa

(10) Patent No.: US 7,648,428 B2
(45) Date of Patent: Jan. 19, 2010

(54) GOLF BALL

(75) Inventor: Hiroyuki Nagasawa, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 355 days.

(21) Appl. No.: 11/299,947

(22) Filed: Dec. 13, 2005

(65) Prior Publication Data

US 2007/0135234 A1 Jun. 14, 2007

(51) Int. Cl.
*A63B 37/06* (2006.01)

(52) U.S. Cl. ..... 473/378

(58) Field of Classification Search ..... 473/378–385
See application file for complete search history.

(56) References Cited

U.S. PATENT DOCUMENTS 4,798,386 A * 1/1989 Berard ..... 473/374
5,688,595 A * 11/1997 Yamagishi et al. ..... 428/375
5,935,023 A * 8/1999 Maehara et al. ..... 473/384
5,989,135 A * 11/1999 Welch ..... 473/353
6,022,279 A 2/2000 Yamagishi et al.
6,193,617 B1 * 2/2001 Mertens ..... 473/351
6,346,053 B1 * 2/2002 Inoue et al. ..... 473/378
2004/0176188 A1 * 9/2004 Morgan et al. ..... 473/378
2004/0266553 A1 12/2004 Park et al.
2004/0266554 A1 12/2004 Park et al.

FOREIGN PATENT DOCUMENTS

JP 10-155937 A 6/1998
JP 2002-102389 A 4/2002

* cited by examiner

*Primary Examiner*—Raeann Trimiew
(74) *Attorney, Agent, or Firm*—Sughrue Mion, PLLC

(57) ABSTRACT

The invention provides a golf ball composed of a core and a cover of one or more layer that encloses the core, which cover has an outermost layer on which a plurality of dimples are formed. The outermost layer is made of one or more thermoplastic or thermoset resin as a base material, and includes therein one or more light-collecting fluorescent dye. Also, 80% of the dimples formed in the outermost layer have a dimple edge angle of 5 to 30°. The surface of the ball exhibits fluorescence even in bad weather or low light conditions, giving the ball excellent visibility and also making the ball highly fashionable.

16 Claims, 4 Drawing Sheets

GOLF BALL

BACKGROUND OF THE INVENTION

The present invention relates to a golf ball which exhibits a fluorescent color that gives the ball excellent visibility in bad weather and at dawn and dusk, and makes it highly fashionable.

Golf is sometimes played even when it is raining or snowing. In bad weather, it is not always easy to see the ball. Generally, when golf is played on a day of fine weather, because the golf ball has a surface that is white and very bright, the player can easily see the ball even if it goes into the rough or an area of high vegetation. However, under poor light conditions, such as in bad weather and in the morning and evening, the ball becomes hard to see, making the game less enjoyable to play. A desire thus exists for golf balls which have a good visibility even in low-light weather.

Recently, as the range of individuals playing golf has grown, various highly fashionable golf balls targeted at beginners and women are being devised. For example, JP-A 10-155937 teaches a colored ball which is visually comfortable and readily acceptable to golfers used to hitting white balls. JP-A 2002-102389 discloses a golf ball formulated with a liquid-crystal polymer, which ball is radiant and changes color with the viewing angle.

However, merely providing the surface of the golf ball with greater fashionability while sacrificing fundamental characteristics of the ball, such as its flight, feel on impact and durability, only lowers the intrinsic value of the ball. When phosphorescent pigments are used to make the surface of the ball luminance, as described in Published U.S. Patent Application No. 2004/0266554, the speed of the luminescent response leaves something to be desired. And when photochromic pigments that exhibit chromogenic properties under ultraviolet irradiation are used, as described in published U.S. Patent Application No. 2004/0266553, the color change weakens over time.

SUMMARY OF THE INVENTION

It is therefore an object of the present invention to provide a golf ball which has excellent visibility in bad weather and at dawn and dusk, and which is highly fashionable.

We have conducted extensive investigations in order to achieve the above object. As a result, we have found that, in a golf ball which is composed of a core and a cover of one or more layer that encloses the core, the cover having an outermost layer on which a plurality of dimples are formed, by having the outermost layer made of a material which is composed of one or more thermoplastic or thermoset resin as the base material and includes therein one or more light-collecting (light-condensing) fluorescent dye, and by providing at least 80% of the dimples formed in the outermost layer with a dimple edge angle of 5 to 30°, under the action of the light-collecting fluorescent dye, the ball collects diffuse light from sunlight even in bad weather and the dimple edge angle portions in particular conspicuously emit light as fluorescent colors, thus giving the ball a very high visibility even during play under low-light weather conditions.

Accordingly, the invention provides the following solid golf balls.

[1] A golf ball composed of a core and a cover of one or more layer that encloses the core, which cover has an outermost layer on which a plurality of dimples are formed, the ball being characterized in that the outermost layer is made of one or more thermoplastic or thermoset resin as a base material and includes therein one or more light collecting (light-condensing) fluorescent dye, and in that at least 80% of the dimples formed on the outermost layer have a dimple edge angle of 5 to 30° .

[2] The golf ball of [1] above, wherein the outermost layer contains the light-collecting fluorescent dye in an amount of 0.001 to 0.03 part by weight per 100 parts by weight of the base resin.

[3] The golf ball of [1] above, wherein the outermost layer contains titanium oxide in an amount of 0 to 0.03 part by weight per 100 parts by weight of the base resin.

[4] The golf ball of [1] above, wherein the outermost layer contains from 0.001 to 0.03 part by weight of a light collecting fluorescent dye having a purity of at least 95% and at most 0.03 part by weight of titanium oxide per 100 parts by weight of the base resin.

[5] The golf ball of [1] above, wherein the light-collecting fluorescent dye has a perylene or naphthalimide skeleton.

[6] The golf ball of [1] above, wherein the light-collecting fluorescent dye has a Stokes shift of 60 nm or less.

[7] The golf ball of [1] above, wherein the resin material in the outermost layer is an ionomer resin or a urethane resin.

[8] A golf ball composed of a core and a multilayer cover that encloses the core, which cover has an outermost layer on which a plurality of dimples are formed, the ball being characterized in that at least one cover layer inside of the outermost layer is made of one or more thermoplastic or thermoset resin as a base material and includes one or more light-collecting fluorescent dye, and in that at least 80% of the dimples formed on the outermost layer have a dimple edge angle of 5 to 30°.

BRIEF DESCRIPTION OF THE DIAGRAMS

Figure 7:
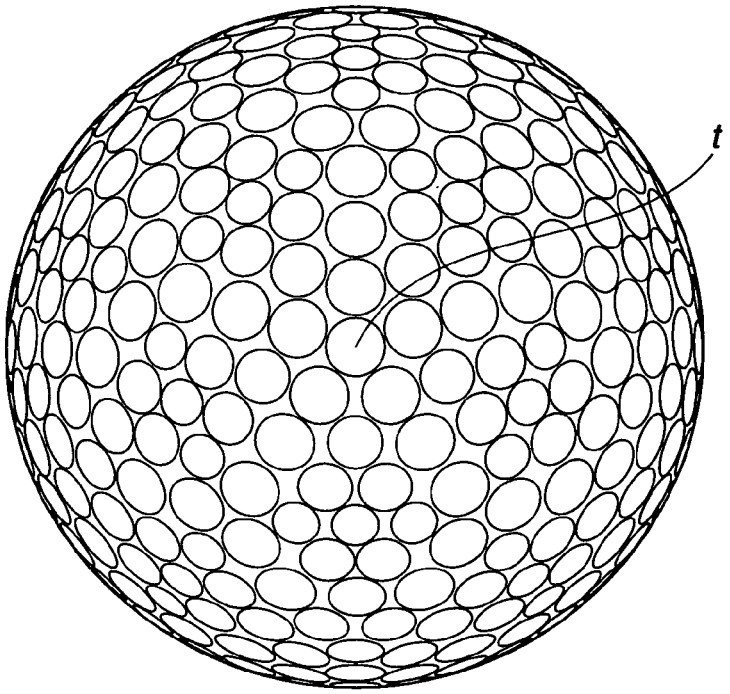

FIG. 7 a plan view showing yet another example of a dimple arrangement on a golf ball.

Figure 8:
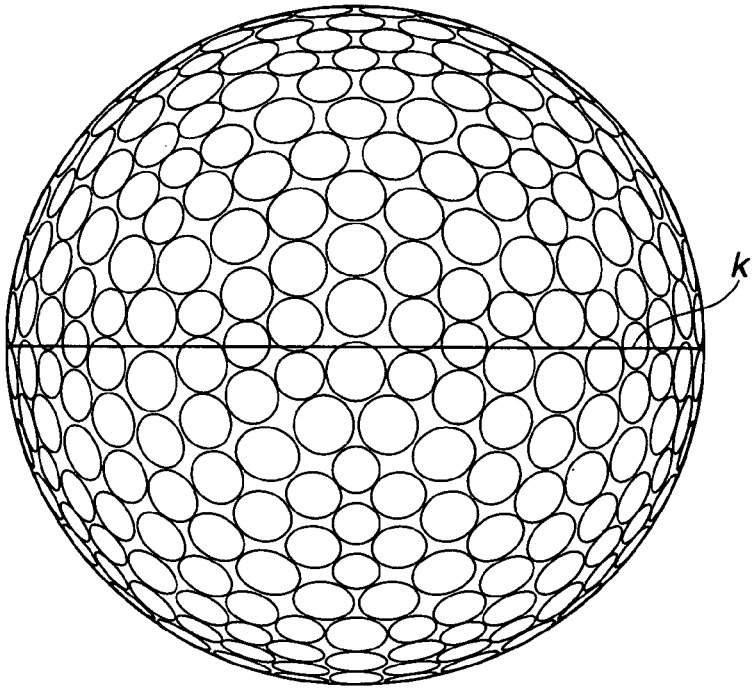

FIG. 8 is a front view showing the same dimple arrangement.

DETAILED DESCRIPTION OF THE INVENTION

The invention is described more fully below. The golf ball of the invention is composed of a core and a cover of one or more layer that encloses the core. The cover has an outermost layer on which a plurality of dimples are formed.

The solid core can be formed using a known rubber composition. The base rubber is exemplified by polybutadiene. Specifically, it is recommended that the base rubber be composed primarily of cis-1,4-polybutadiene having a cis structure content of at least 40%. The base rubber may also contain, together with the foregoing polybutadiene, other types of rubber, such as natural rubber, polyisoprene rubber or styrene-butadiene rubber.

The metal salt (e.g., zinc salt, magnesium salt, calcium salt) of an unsaturated fatty acid (e.g., methacrylic acid, acrylic acid), or an ester compound such as trimethylolpropane trimethacrylate, may be compounded in the rubber composition as a co-crosslinking agent. For a high resilience, the use of zinc acrylate is especially preferred. Such co-crosslinking agents can be included in an amount of generally at least 10 parts by weight, and preferably at least 15 parts by weight, but not more than 50 parts by weight, and preferably not more than 40 parts by weight, per 100 parts by weight of the base rubber.

An organic peroxide can be included in the rubber composition. Illustrative examples include 1,1-bis(t-butylperoxy-3,3,5-trimethylcyclohexane), dicumyl peroxide, di(t-butylperoxy)-meta-diisopropylbenzene and 2,5-dimethyl-2,5-di-t-butylperoxyhexane. Examples of commercially available products include Percumil D (produced by NOF Corporation) and Trigonox 29-40 (Kayaku Akzo KK). The amount of organic peroxide included per 100 parts by weight of the base resin is generally at least 0.1 part by weight, and preferably at least 0.5 part by weight, but not more than 5 parts by weight, and preferably not more than 2 parts by weight.

If necessary, the above composition may include also various types of additives. Examples of such additives include sulfur, antioxidant, zinc oxide, barium sulfate, the zinc salt of pentachlorothiophenol and zinc stearate. No particular limitation is imposed on the amounts in which these additives are compounded.

The core has a diameter of preferably at least 32.0 mm, and more preferably at least 33.0 mm, but preferably not more than 40.5 mm, and more preferably not more than 39.5 mm.

The solid core has a deflection (amount of deflection (deformation) when subjected to a load of 1275 N (130 kgf) from an initial load of 98 N (10 kgf)) of 2.5 to 5.0 mm, preferably 3.0 to 4.5 mm, and more preferably 3.5 to 4.0 mm. If the deflection is too low, the golf ball may have a hard feel when hit with a driver and a poor scuff resistance. On the other hand, if the deflection is too high, the ball may have too soft a feel when hit with a driver and a considerably shorter distance of travel.

The solid core can be produced by a known method. To obtain a solid core from the core-forming rubber composition, preferred use can be made of a process in which the composition is masticated using an ordinary mixing apparatus (e.g., a Banbury mixer, kneader or roll mill), and the resulting compound is compression molded in a core mold.

In the practice of the invention, the cover enclosing the solid core is composed of one or more layers. The base material in each layer of the cover is preferably a thermoplastic resin or a thermoset resin. The use of a thermoplastic resin or a thermoplastic elastomer is especially preferred. Exemplary thermoplastic resins include ionomer resins. Commercial ionomer resins that may be used include Himilan (ionomer resins produced by DuPont-Mitsui Polychemicals Co., Ltd.), Surlyn (ionomer resins produced by E.I. du Pont de Nemours and Co.) and Iotek (ionomer resins produced by Exxon Corporation). Exemplary thermoplastic elastomers include polyester, polyamide, polyurethane, olefin and styrene elastomers. Commercial thermoplastic elastomers that may be used include Hytrel (produced by DuPont-Toray Co., Ltd.), Perprene (produced Toyobo Co., Ltd.), Pebax (produced by Toray Industries, Inc.), Pandex (produced by Dainippon Ink & Chemicals, Inc.), Santoprene (produced by Monsanto Chemical Co.), Tuftec (produced by Asahi Kasei Kogyo Co., Ltd.) and Dynaron (produced by JSR Corporation). It is preferable for the thermoplastic resin or thermoplastic elastomer to be an ionomer resin or a thermoplastic polyurethane elastomer.

In the invention, one or more light-collecting fluorescent dye (or light-condensing fluorescent dye) is compounded in the base resin making up the outermost layer of the cover, or at least one cover layer inside the outermost layer.

As used herein, "light-collecting fluorescent dye" refers to a material which collects sunlight and has the ability to convert the wavelength of the collected light to a longer wavelength as fluorescent light. Light is collected at the surface of the colored material, and intense fluorescence is emitted at the dimple edges. Both the maximum absorption wavelength band and the maximum excitation wavelength band lie within the visible light spectrum.

In the practice of the invention, use is made of a fluorescent dye rather than a fluorescent pigment. The reason is that pigments are generally bulk materials composed of a dyestuff dispersed in a medium of some kind, and have a larger particle size than dyes. Hence, they tend to irregularly reflect light, resulting in superficial luminescence. In addition, dyes are better than pigments from the standpoint of depth of color, glossiness, and transparency. Using a fluorescent dye provides the excellent chromogenic effect that is the aim of the invention, resulting in a high visibility.

For a high luminance and high heat resistance, it is preferable that the light-collecting fluorescent dye has a perylene or naphthalimide skeleton.

To achieve a high fluorescent intensity, it is preferable for the light-collecting fluorescent dye to have a Stokes shift of 60 nm or less, and especially 50 nm or less. The Stokes shift is generally the difference between the absorption spectrum and the fluorescence spectrum.

Although the purity of the light-collecting fluorescent dye is not subject to any particular limitation, to achieve a sufficient light collecting ability, the purity is preferably at least 95%, more preferably at least 97%, and most preferably at least 99%.

Preferred fluorescent dyes include those which are orange, pink, red, yellow, blue, or violet. Commercial products can be used for any of these chromogenic systems. Illustrative examples of such commercial products include those produced under the trade names Lumogen F Yellow 083, Lumogen F Orange 240, Lumogen F Red 305 and Lumogen F Blue 650 (all products of BASF AG).

To obtain sufficient coloration and brightness, and to reduce costs, it is desirable for the light-collecting fluorescent dye to be included in an amount, per 100 parts by weight of the base resin, of from 0.001 to 0.03 part by weight, and especially from 0.01 to 0.03 part by weight.

Titanium oxide can be included in the outermost layer to impart whiteness to the surface of the ball. Because the incorporation of too much titanium oxide increases its hiding power, it is preferable that only a small amount be added. Specifically, an amount of not more than 0.03 part by weight per 100 parts by weight of the base resin is preferred.

It is recommended that each layer of the cover have a Shore D hardness of at least 40, and preferably at least 43, but not more than 62, and preferably not more than 60. Too great a hardness makes it difficult to achieve a suitable spin on approach shots, which may lower the controllability of the ball. On the other hand, if the Shore D hardness is too low, the ball may have a poor rebound, shortening the carry.

In the golf ball of the invention, aside from the foregoing fluorescent dye, to further enhance the color variation and fashionability, various types of colorants may be added to a cover material composed primarily of a clear or semi-clear resin. Various known materials can be used as such colorants. For example, blue pigments that may be used include Prussian blue, phthalocyanine blue and cobalt blue. Yellow pigments that may be used include chrome yellow, zinc yellow, cadmium yellow, yellow iron oxide and nickel titanium yellow. The cover material may also have added thereto, for example, glass flakes and luster pigments such as pearlescent pigments. Moreover, to enhance the color variation and fashionability, the above-mentioned colorants and brightness-imparting agents may be added to an inside layer adjoining the cover layer to which the fluorescent dye is added.

Various additives, such as UV absorbers, antioxidants, metal soaps, pigments other than the above and inorganic fillers, may be added in appropriate amounts to the base resin of the cover.

It is desirable for each layer of the cover to be formed to a thickness of at least 0.5 mm, and preferably at least 0.8 mm, but not more than 3.0 mm, and preferably not more than 2.2 mm. If each layer of the cover is too thin, a sufficient spin performance may not be achieved and the ball may have a poor durability to cracking on repeated impact.

Figure 1:
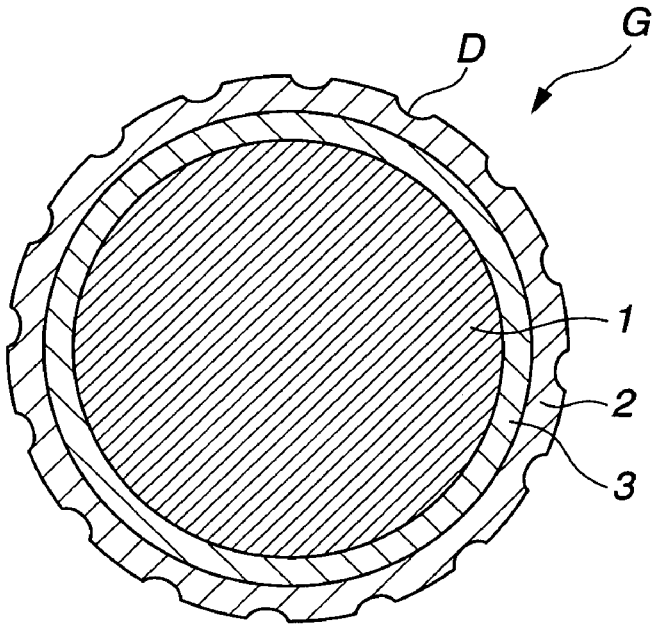
FIG. 1 is schematic cross-sectional view of a golf ball according to the invention which has a three-layer construction.

FIG. 1 shows a golf ball G that illustrates an embodiment of the invention in which the cover is formed of two layers. As shown in FIG. 1, this golf ball G has a core 1 and a cover which encloses the core. The cover has an outermost layer 2 on an outside surface of which are formed numerous dimples D. To the inside of the outermost layer 2, there is formed a single inner layer 3 (referred to below simply as the "inner cover layer").

The base material of the inner layer is a thermoplastic resin. The thermoplastic resin used for this purpose is preferably one of those mentioned above in connection with the outermost layer.

It is advantageous for the inner cover layer to have a hardness which is lower than that of the outermost layer of the cover and, expressed as the Shore D hardness, is preferably at least 45, and more preferably at least 48, but preferably not more than 55, and more preferably not more than 53. If the inner cover layer has a Shore D hardness that is too low, the ball may have a poor rebound, resulting in a shorter carry. On the other hand, if the Shore D hardness is too high, the feel of the ball may worsen and the scuff resistance may diminish.

It is desirable for the inner layer of the cover to be formed so as to have a thickness of at least 0.8 mm, and preferably at least 1.2 mm, but not more than 2.2 mm, and preferably not more than 1.8 mm. If the inner layer is too thin, the durability to cracking with repeated impact may worsen. On the other hand, if the inner layer is too thick, the ball may have a smaller rebound, shortening the carry.

In the foregoing golf ball, although the above-described light-collecting fluorescent dye may be included in the resin material of which the outermost layer of the cover is made, it is possible instead to include one or more such light-collecting fluorescent dye in the resin material making up the inner layer of the cover. Alternatively, such a light-collecting fluorescent dye may be included in the resin material making up the outermost layer of the cover and may also be included in the resin material making up the inner layer of the cover.

A known process such as injection molding or compression molding may be employed to obtain golf balls composed of a solid core encased within the above-described cover. For example, when injection molding is carried out, production may involve setting a prefabricated solid core within the mold and injecting the cover material into the mold by a conventional method.

To form numerous dimples on the surface of the golf ball cover, it is advantageous to carry out injection molding using a mold having a cavity therein on the walls of which numerous dimple-forming projections are formed.

No particular limitation is imposed on the diameter and depth of the dimples, although the dimple diameter can be set to from 2 to 5 mm, and preferably from 2.4 to 4.5 mm, and the dimple depth can be set to from 0.05 to 0.3 mm. The number of dimples is preferably from 240 to 620, and more preferably from 318 to 500. The dimples have a planar shape that is generally circular, although some or all of the dimples may be non-circular in shape. In addition, the dimples generally have a recessed shape, although some or all of the dimples may be raised dimples. These dimples may be of one type having the same diameter and depth, or may be of two or more types of differing diameter and/or depth. An arrangement of two to five types, and especially two to four types, of dimples of differing diameter is preferred. The dimple configuration is not subject to any particular limitation. Examples of suitable configurations that may be used include regular octahedral, regular dodecahedral and regular icosahedral configurations.

The edge angle of the dimples formed on the golf balls of the invention is preferably from 5 to 30°, and especially from 8 to 25°. It is critical that at least 80%, preferably at least 90%, of the dimples have edge angles which fall within the above range. By setting the dimple edge angle within a specific range in this way, the light-collecting fluorescent dye present in at least one layer of the cover collects direct sunlight and diffuse light and emits intense fluorescence from the dimple edge angle, enabling fluorescent colors to be exhibited even under low-light weather conditions.

To provide contrast, dimples having an edge angle outside of the above range may be intentionally included within a range of up to 20%, preferably up to 10%, of the total number of dimples, and the placement pattern for such dimples may involve random placement or regular placement.

If the dimple edge angle is too small, the ball may have a somewhat steep trajectory. On the other hand, if the angle is too large, the edge may tend to damage easily. In the design and placement of the dimples, an optimal dimple pattern that provides a good balance between the ball flight characteristics and the design features should be selected.

Figure 2:
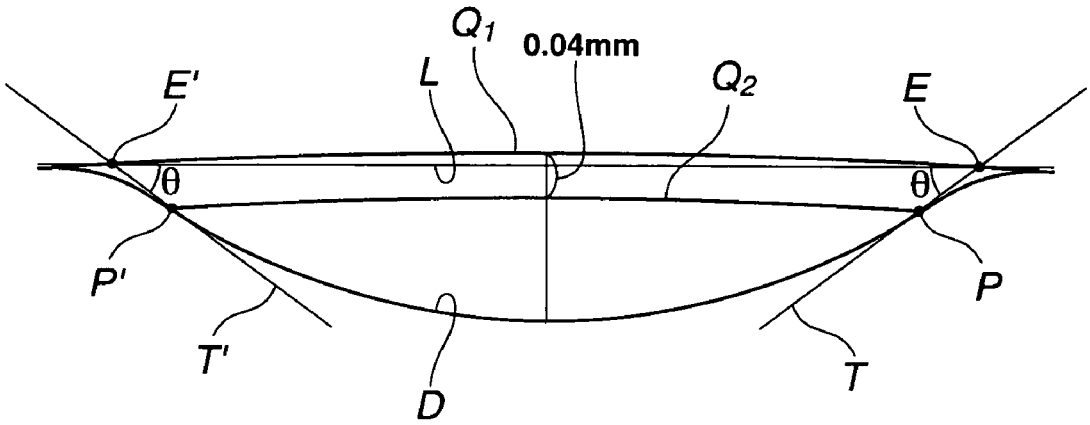
FIG. 2 is a diagram illustrating the dimple edge angle.

The dimple edge angle is defined as follows. As shown in FIG. 2, let us imagine over the dimple D a first spherical golf ball surface (i.e., the spherical surface of the golf ball were it to have no dimples) $Q_1$ prior to formation of the dimple. Let us also imagine a second spherical surface $Q_2$ which is centered at the center point of the golf ball and has a radius 0.04 mm smaller than that of the first spherical surface $Q_1$. If we then draw tangents T and T' at points P and P' where the spherical surface $Q_2$ intersects the wall of the dimple D, the points E and E' where the tangents T and T' intersect the first spherical surface $Q_1$ represent the respective edges of the dimple D. The angle θ between the line segment (straight line) L connecting points E and E' determined in this way and the above tangents T and T' is the edge angle. The distance between above points E and E' is the diameter of the dimple D. The depth of the dimple D is the distance between the center portion at the bottom of the dimple D and the line segment L.

In the practice of the invention, the golf ball that has been molded can be trimmed, painted and otherwise treated in accordance with conventional known processes to give the finished golf ball. It should be noted that the dimple edge angle described above signifies herein the edge angles of the dimples in the finished golf ball.

It is recommended that the inventive golf ball formed as described above have a deflection, expressed as the amount of deformation by the ball when subjected to a load of 1275 N (130 kgf) from an initial load of 98 N (10 kgf), of generally at least 2.0 mm, preferably at least 2.3 mm, and more preferably at least 2.5 mm, but not more than 4.0 mm, preferably not more than 3.5 mm, and more preferably not more than 3.2 mm. If the ball has a deflection hardness that is smaller than the above range, the ball may have a poor feel on impact and may acquire too much spin on shots taken with an iron, which can significantly shorten the carry. Conversely, if the ball has a deflection that is larger than the above range, the ball may have a poor rebound, resulting in a shorter carry, particularly on shots taken with a driver.

The golf ball according to the invention can be formed, in accordance with the Rules of Golf, to a diameter of not less than 42.67 mm and a weight of not more than 45.93 g.

As described above, the golf ball of the invention exhibits fluorescent properties at the surface thereof and has excellent visibility even in poor weather and poor light conditions.

EXAMPLES

The following examples of the invention and comparative examples are provided by way of illustration and not by way of limitation.

Examples 1 to 6, Comparative Examples 1 to 4

Solid cores were produced by using the rubber compositions shown in Table 1 and vulcanizing at 157° C. for 15 minutes.

Details of the core materials in Table 1 are given below.

Polybutadiene

Trade name: BR01 (produced by JSR Corporation)

Antioxidant 2,2-Methylenebis(4-methyl-6-tert-butylphenol)

Trade name: Nocrac NS-6 (produced by Ouchi Shinko Chemical Industry Co., Ltd.)

Peroxide (1)

Dicumyl peroxide

Trade name: Percumil D (produced by NOF Corporation)

Peroxide (2)

1,1-Bis(t-butylperoxy)-3,3,5-trimethylcyclohexane

Trade name: Perhexa 3M-40 (produced by NOF Corporation)

Next, in each example, an inner cover layer material of the composition shown in Table 2 was mixed at 200 to 220° C. in a kneading-type twin-screw extruder, giving the inner cover layer material in pelletized form. This material was then injected into a mold in which the above-described solid core had been placed, thereby producing a solid core enclosed by the inner cover layer material.

In addition, an outer cover layer material of the composition shown in Table 2 was mixed at 200° C. in a kneading-type twin-screw extruder, giving the outer cover layer material in pelletized form. This material was then injected into a mold in which the above-described solid core enclosed in an inner cover layer material had been placed, thereby producing a three-piece solid golf ball having the cross-sectional structure shown in FIG. 1.

TABLE 1

| | Example | | | | | | Comparative Example | | | |
|---|---|---|---|---|---|---|---|---|---|---|
| (parts by weight) | 1 | 2 | 3 | 4 | 5 | 6 | 1 | 2 | 3 | 4 |
| Polybutadiene | 100 | 100 | 100 | 100 | 100 | 100 | 100 | 100 | 100 | 100 |
| Zinc acrylate | 28.5 | 28.5 | 28.5 | 28.5 | 28.5 | 28.5 | 28.5 | 28.5 | 28.5 | 28.5 |
| Zinc oxide | 31.3 | 31.3 | 31.3 | 31.3 | 31.3 | 31.3 | 31.3 | 31.3 | 31.3 | 31.3 |
| Antioxidant | 0.1 | 0.1 | 0.1 | 0.1 | 0.1 | 0.1 | 0.1 | 0.1 | 0.1 | 0.1 |
| Zinc stearate | 5 | 5 | 5 | 5 | 5 | 5 | 5 | 5 | 5 | 5 |
| Zinc salt of pentachlorothiophenol | 1 | 1 | 1 | 1 | 1 | 1 | 1 | 1 | 1 | 1 |
| Peroxide (1) | 0.6 | 0.6 | 0.6 | 0.6 | 0.6 | 0.6 | 0.6 | 0.6 | 0.6 | 0.6 |
| Peroxide (2) | 0.6 | 0.6 | 0.6 | 0.6 | 0.6 | 0.6 | 0.6 | 0.6 | 0.6 | 0.6 |

TABLE 2

| | | Example | | | | | | Comparative Example | | | |
|---|---|---|---|---|---|---|---|---|---|---|---|
| | (parts by weight) | 1 | 2 | 3 | 4 | 5 | 6 | 1 | 2 | 3 | 4 |
| Outermost layer of cover | Himilan 1557 | 50 | 50 | 50 | 50 | 50 | | 50 | 50 | 50 | |
| | Himilan 1601 | 50 | 50 | 50 | 50 | 50 | | 50 | 50 | 50 | |
| | Pandex T8295 | | | | | | 50 | | | | 50 |
| | Pandex T8260 | | | | | | 50 | | | | 50 |
| | Magnesium stearate | 1 | 1 | 1 | 1 | 1 | | 0.5 | 0.5 | 0.5 | |
| | Polyethylene wax | | | | | | 1 | | | | 1 |
| | Titanium oxide | 0 | 0 | 0.01 | 0 | 0 | 0 | 0 | 0.3 | 0 | 3 |
| | Light-collecting fluorescent dye 1 | 0.02 | | | | | 0.01 | | | | |
| | Light-collecting fluorescent dye 2 | | 0.015 | | | | | | | | |
| | Light-collecting fluorescent dye 3 | | | 0.02 | 0.02 | 0.01 | | | | | |
| | Light-collecting fluorescent dye 4 | | | | | 0.01 | | | | | |
| | Yellow pigment | | | | | | | | 5 | | |
| | Blue pigment | | | | | | | | | 3 | 0.3 |

TABLE 2-continued

| | | Example | | | | | | Comparative Example | | | |
|---|---|---|---|---|---|---|---|---|---|---|---|
| | (parts by weight) | 1 | 2 | 3 | 4 | 5 | 6 | 1 | 2 | 3 | 4 |
| Inner cover layer | Surlyn 7930 | 22.5 | 22.5 | 22.5 | 22.5 | 22.5 | 22.5 | 22.5 | 22.5 | 22.5 | 22.5 |
| | AM7311 | 22.5 | 22.5 | 22.5 | 22.5 | 22.5 | 22.5 | 22.5 | 22.5 | 22.5 | 22.5 |
| | Nucrel AN4318 | 25 | 25 | 25 | 25 | 25 | 25 | 25 | 25 | 25 | 25 |
| | Dynaron E6100P | 30 | 30 | 30 | 30 | 30 | 30 | 30 | 30 | 30 | 30 |
| | Titanium oxide | 0.3 | 0.3 | 0.3 | 0 | 0.3 | 0.1 | 0.1 | 0.1 | 0.1 | 0.1 |
| | Light-collecting fluorescent dye 1 | | | | 0.02 | | | | | | |
| | Magnesium stearate | 0.35 | 0.35 | 0.35 | 0.35 | 0.35 | 0.35 | 0.35 | 0.35 | 0.35 | 0.35 |

Details on trade names and on pigments and other constituents in the foregoing table are given below.

Outermost Layer of Cover

Himilan 1557, Himilan 1601: Ionomer resins produced by DuPont-Mitsui Polychemicals Co., Ltd.

Pandex T8295, T8260: MDI-PTMG type thermoplastic polyurethanes produced by DIC Bayer Polymer, Ltd.

Polyethylene wax: Produced by Sanyo Chemical Industries, Ltd. under the trade name Sanwax 161P.

Light-collecting fluorescent dye 1: Produced by BASF AG under the trade name Lumogen F Yellow 083

Light-collecting fluorescent dye 2: Produced by BASF AG under the trade name Lumogen F Orange 240

Light-collecting fluorescent dye 3: Produced by BASF AG under the trade name Lumogen F Red 305

Light-collecting fluorescent dye 4: Produced by BASF AG under the trade name Lumogen F Blue 650

Blue Pigment: Produced by Resino Color Industry Co., Ltd. under the trade name Resino Blue RT-K.

Yellow Pigment: Produced by Resino Color Industry Co., Ltd. under the trade name Resino Yellow 3GR #55.

Inner Layer of Cover

Surlyn 7930: An ionomer resin produced by E.I. du Pont de Nemours and Co.

AM7311: An ionomer resin produced by DuPont-Mitsui Polychemicals Co., Ltd.

Nucrel AN4318: An ethylene-methacrylic acid-acrylic acid ester terpolymer produced by DuPont-Mitsui Polychemicals Co., Ltd.

Dynaron E6100P: A block copolymer having crystalline olefin blocks, produced by JSR Corporation.

Others: The remaining constituents are the same as those described above for the outermost layer of the cover.

Numerous dimples are formed on the outside surface of the outermost layer of the cover. The configurations of these dimples are as described below. Dimple structure details are given in Table 3.

Dimple Configurations

Figure 3:
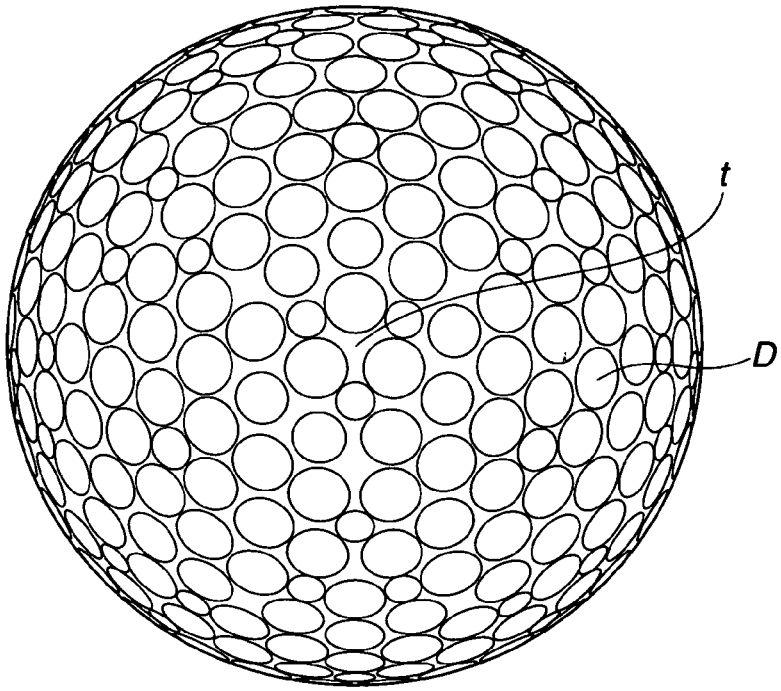
FIG. 3 is a plan view showing an example of a dimple arrangement on a golf ball.
Figure 4:
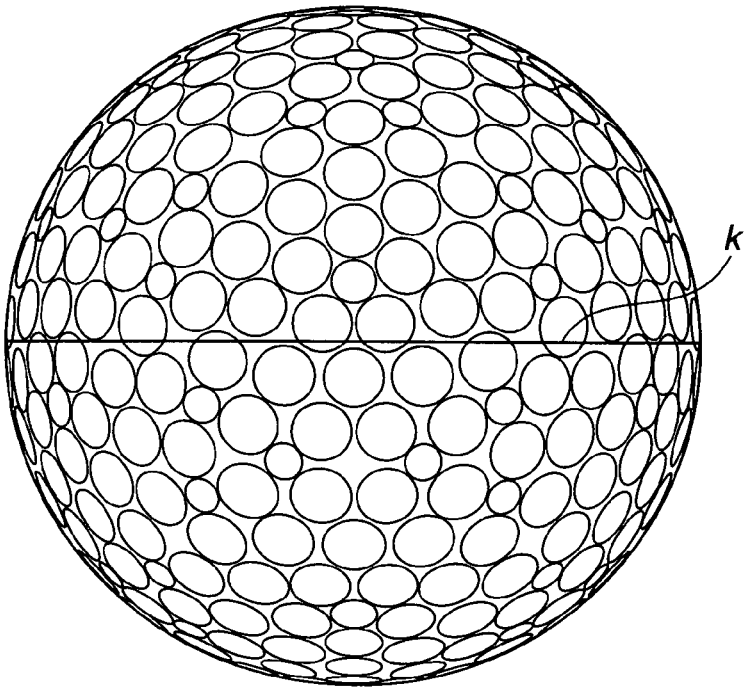
FIG. 4 is a front view showing the same dimple arrangement.

Configuration I: FIGS. 3 and 4
(regular icosahedral configuration)

Figure 5:
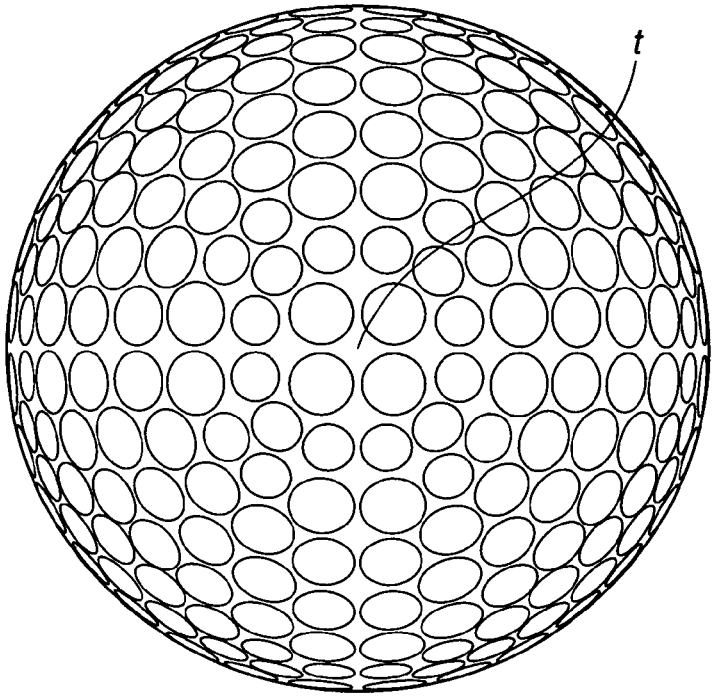
FIG. 5 is a plan view showing another example of a dimple arrangement on a golf ball.
Figure 6:
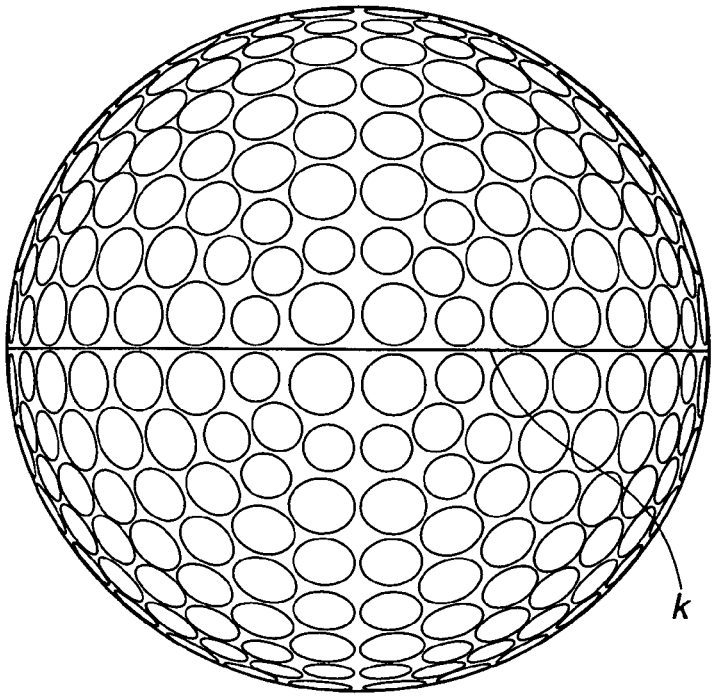
FIG. 6 is a front view showing the same dimple arrangement.

Configuration II: FIGS. 5 and 6
(regular octahedral configuration)

Configuration III: FIGS. 7 and 8
(regular icosahedral configuration)

In the diagrams, the letter t represents a pole, and the letter k represents the equator.

TABLE 3

| Configuration I | | | | | | | | | |
|---|---|---|---|---|---|---|---|---|---|
| Dimple types | 1 | 2 | 3 | 4 | 5 | 6 | 7 | Total | Average |
| Number of dimples | 234 | 48 | 12 | 60 | 42 | 24 | 12 | 432 | |
| Dimple edge angle θ (°) | 13.3 | 12.5 | 9.4 | 9.5 | 12.8 | 13.6 | 13.6 | | 12.6 |

| Configuration II | | | | | | | | |
|---|---|---|---|---|---|---|---|---|
| Dimple types | 1 | 2 | 3 | 4 | 5 | 6 | Total | Average |
| Number of dimples | 40 | 184 | 114 | 32 | 16 | 6 | 392 | |
| Dimple edge angle θ (°) | 14.2 | 13.5 | 10.4 | 15.4 | 14.5 | 11.6 | | 12.8 |

| Configuration III | | | | | |
|---|---|---|---|---|---|
| Dimple types | 1 | 2 | 3 | 4 | Total | Average |
| Number of dimples | 120 | 132 | 120 | 90 | 462 | |
| Dimple edge angle θ (°) | 13.3 | 12.5 | 11.8 | 9.5 | | 11.9 |

The characteristics of each of the resulting golf balls are shown in Table 4. The following methods were used to evaluate the appearance and properties of the balls.

Ball Hardness and Solid Core Hardness

The compressive deformation (mm) of each of the resulting golf balls and solid cores when subjected to loading from an initial load of 10 kgf (98.07 N) to a final load of 130 kgf (1274.91 N) was measured.

Hardness of Inner Cover Layer and Outermost Cover Layer

The cover materials were formed into 1 mm thick sheets. The hardness was the Shore D hardness measured according to ASTM D-2240.

Initial Velocity of Ball

Measured in accordance with the USGA (R&A) measurement method.

Ball Appearance (I) Color tone:

Examined visually.

(II) Brightness as a reflection of dimple shape:

Rated, in order of decreasing desirability, as Very intense, Intense, Weak, or None.

TABLE 4

| | | Example | | | | | | Comparative Example | | | |
|---|---|---|---|---|---|---|---|---|---|---|---|
| | | 1 | 2 | 3 | 4 | 5 | 6 | 1 | 2 | 3 | 4 |
| Solid core | Diameter (mm) | 36.4 | 36.4 | 36.4 | 36.4 | 36.4 | 36.4 | 36.4 | 36.4 | 36.4 | 36.4 |
| | Deflection (mm) | 3.5 | 3.5 | 3.5 | 3.5 | 3.5 | 3.5 | 3.5 | 3.5 | 3.5 | 3.5 |
| Cover inner layer | Thickness (mm) | 1.65 | 1.65 | 1.65 | 1.65 | 1.65 | 1.65 | 1.65 | 1.65 | 1.65 | 1.65 |
| | Shore D hardness | 51 | 51 | 51 | 51 | 51 | 51 | 51 | 51 | 51 | 51 |
| Cover outermost layer | Thickness (mm) | 1.5 | 1.5 | 1.5 | 1.5 | 1.5 | 1.5 | 1.5 | 1.5 | 1.5 | 1.5 |
| | Shore D hardness | 60 | 60 | 60 | 60 | 60 | 51 | 60 | 60 | 60 | 51 |
| Dimples | Configuration | I | I | II | I | III | I | I | II | III | I |
| | Average edge angle (°) | 12.6 | 12.6 | 12.8 | 12.6 | 11.9 | 12.6 | 12.6 | 12.8 | 11.9 | 12.6 |
| Ball characteristics | Weight (g) | 45.4 | 45.4 | 45.4 | 45.4 | 45.4 | 46.1 | 45.4 | 45.4 | 45.4 | 46.1 |
| | Diameter (mm) | 42.7 | 42.7 | 42.7 | 42.7 | 42.7 | 42.7 | 42.7 | 42.7 | 42.7 | 42.7 |
| | Deflection (mm) | 2.7 | 2.7 | 2.7 | 2.7 | 2.7 | 2.9 | 2.7 | 2.7 | 2.7 | 2.9 |
| | Initial velocity (m/s) | 77.1 | 77.1 | 77.1 | 77.1 | 77.1 | 76.4 | 77.1 | 77.1 | 77.1 | 76.4 |
| Ball appearance | Color tone | yellow, clear | orange, clear | red, semi-clear | red, clear | violet, clear | yellow | clear | yellow, semi-clear | blue, semi-clear | bluish-white |
| | Brightness owing to shape of dimples | Very intense | Very intense | Intense | Very intense | Very intense | Intense | Weak | None | Weak | None |

As is apparent from the results in Table 4, the golf balls according to the invention (Examples 1 to 6) had an excellent brightness owing to the shapes of the dimples, exhibited fluorescent colors and had a good visibility, even in low-light weather conditions. However, the golf balls in Comparative Examples 1 to 4 had a coloration and a brightness that were both inferior, and thus had a poor visibility in low-light weather.

The invention claimed is:

1. A golf ball comprising a core and a cover of one or more layer that encloses the core, which cover has an outermost layer on which a plurality of dimples are formed, the ball being characterized in that the outermost layer is made of one or more thermoplastic or thermoset resin as a base material and includes therein one or more light collecting fluorescent dye, and in that at least 90% of the dimples formed on the outermost layer have a dimple edge angle of 5 to 30°, and wherein the outermost layer contains from 0.001 to 0.03 part weight of a light-collecting fluorescent dye having a purity of at least 95% and from 0.01 to 0.03 part by weight of titanium oxide per 100 parts by weight of the base resin.

2. The golf ball of claim 1, wherein the light-collecting fluorescent dye has a perylene or naphthalimide skeleton.

3. The golf ball of claim 1, wherein the light-collecting fluorescent dye has a Stokes shift of 60 nm or less.

4. The golf ball of claim 1, wherein the resin material in the outermost layer is an ionomer resin.

5. The golf ball of claim 1, wherein each layer of the cover is formed to a thickness of 0.5 to 3.0 mm.

6. The golf ball of claim 1, wherein each layer of the cover has a Shore D hardness of 40 to 62.

7. The golf ball of claim 1, wherein the hardness of at least one cover layer inside of the outermost layer is lower than that of the outermost layer of the cover.

8. The golf ball of claim 1, wherein the golf ball has a deflection, expressed as an amount of deformation by the ball when subjected to a load of 1275 N (130 kgf) from an initial load of 98 N (10 kgf), of 2.0 to 4.0 mm.

9. A golf ball comprising a core and a multilayer cover that encloses the core, which cover has an outermost layer on which a plurality of dimples are formed, the ball being characterized in that each of the outermost layer and at least one cover layer inside of the outermost layer is made of one or more thermoplastic or thermoset resin as a base material and includes one or more light-collecting fluorescent dye, and in that at least 90% of the dimples formed on the outermost layer have a dimple edge angle of 5 to 30°, wherein the outermost layer contains from 0.01 to 0.03 part by weight of titanium oxide per 100 parts by weight of the base resin.

10. The golf ball of claim 9, wherein the light-collecting fluorescent dye has a perylene or naphthalimide skeleton.

11. The golf ball of claim 9, wherein the light-collecting fluorescent dye has a Stokes shift of 60 nm or less.

12. The golf ball of claim 9, wherein the resin material in the outermost layer is an ionomer resin.

13. The golf ball of claim 9, wherein each layer of the cover is formed to a thickness of 0.5 to 3.0 mm.

14. The golf ball of claim 9, wherein each layer of the cover has a Shore D hardness of 40 to 62.

15. The golf ball of claim 9, wherein the hardness of at least one cover layer inside of the outermost layer is lower than that of the outermost layer of the cover.

16. The golf ball of claim 9, wherein the golf ball has a deflection, expressed as an amount of deformation by the ball when subjected to a load of 1275 N (130 kgf) from an initial load of 98 N (10 kgf), of 2.0 to 4.0 mm.

* * * * *